US005557825A

United States Patent [19]

Harr

[11] Patent Number: 5,557,825

[45] Date of Patent: Sep. 24, 1996

[54] DOOR RETAINER MECHANISM FOR AUTOMATICALLY RETAINING ACCESS DOOR ON CABINET IN OPENED POSITION

[75] Inventor: Deborah L. Harr, Columbia, Mo.

[73] Assignee: Hubbell Incorporated, Orange, Conn.

[21] Appl. No.: 323,744

[22] Filed: Oct. 17, 1994

[51] Int. Cl.[6] ..... E05C 17/04

[52] U.S. Cl. ..... 16/82; 49/345

[58] Field of Search ..... 16/82, 83, 86 C, 16/71, 78, 80, 346, 193, 200, 349, 196; 49/339, 394, 345

[56] References Cited

U.S. PATENT DOCUMENTS

| | | | |
|---|---|---|---|
| 206,897 | 8/1878 | Ralston | 16/349 |
| 469,834 | 3/1892 | Demarest | 49/345 |
| 470,349 | 3/1892 | Levy | 49/345 |
| 2,381,132 | 8/1945 | Marchand | 16/346 |
| 2,501,581 | 3/1950 | Rieger | 16/349 |
| 4,339,844 | 7/1982 | Shatters | 16/82 |

*Primary Examiner*—M. Rachuba
*Assistant Examiner*—Donald M. Gurley
*Attorney, Agent, or Firm*—Jerry M. Presson; Michael R. Swartz

[57] ABSTRACT

A door retainer mechanism on a padmounted switchgear cabinet includes a pair of elongated links coupled between an access door and housing of the cabinet. The links are pivotally connected respectively to the access door and housing and also pivotally connected to one another. The links are pivotable relative to each other between folded and unfolded conditions with respect to one another as the access door is moved between closed and opened positions relative to the cabinet housing. The links are operable automatically to latch with one another in the unfolded condition upon the access door reaching the opened position after being moved by a worker from the closed position relative to the cabinet housing. The links of the door retainer mechanism, once they have reached the unfolded condition and become latched with one another, function to retain the access door in the opened position and prevent the access door from returning to the closed position. The door retainer mechanism only allows the access door to return to the closed position after the links have been unlatched manually from one another by the worker and allowed to return to the folded condition with respect to one another. The door retainer mechanism also includes first and second stop elements mounted to a respective one of the first and second links and engageable with the respective other thereof so as to prevent the links from over-shooting the respective folded and unfolded conditions.

8 Claims, 4 Drawing Sheets

DOOR RETAINER MECHANISM FOR AUTOMATICALLY RETAINING ACCESS DOOR ON CABINET IN OPENED POSITION

BACKGROUND OF THE INVENTION

1. Field of the Invention

The present invention generally relates to padmounted switchgear cabinets and, more particularly, is concerned with a door retainer mechanism for latching automatically and retaining an access door on a padmounted switchgear cabinet in a desired opened position once the access door has been moved to such position and until the access door has been manually released from such position.

2. Description of the Prior Art

One common electrical utility switch installation, generally known as a padmounted switchgear, typically employs a cabinet having a housing and a pair of front access doors hinged at their outer vertical edges to the housing for undergoing pivotal movement between closed and opened positions. In closed positions, the access doors are disposed in a flush relationship with the front of the housing, extending across an access opening defined therein. In opened positions, the access doors are each disposed in opposite angular relationships with the front of the housing, extending away from the housing front.

Whenever an access door to a padmounted switchgear cabinet is opened, it is important that it be secured in the opened position so that it cannot close unexpectedly on a worker. Without some means of securing the door in the opened position, wind or other activity adjacent to the installation could cause the access door to close unexpectedly and inadvertently, resulting in possible injury to an unsuspecting worker caught in the path of the moving access door.

Conventional practice in the padmounted switchgear field is to secure the access door in the opened position by a worker using some form of manually operated retaining mechanism, usually a rod mounted on the rim of the cabinet housing and manually inserted into a receiving hole on the open access door. However, the effectiveness of this manually operated retaining mechanism is completely dependent on the worker connecting up the retaining mechanism after opening the access door. Thus, this approach is by no means fail safe in the sense that it depends upon the worker to implement its retaining function. There are automatic door retainers on the market that exist for various other applications, however, these are not suitable for switchgear applications because for such applications the retainer needs to be compact in size and that at no point during opening or closing may any part of the retainer enter the interior of the enclosure.

Consequently, a need exists for a design of an automatic door retainer mechanism which is compact in size, does not enter the enclosure during opening and closing, and which will function without any action being required by a worker to implement its retaining function other than merely opening the access door.

SUMMARY OF THE INVENTION

The present invention provides a door retainer mechanism designed to satisfy the aforementioned needs. The door retainer mechanism of the present invention is adapted to latch automatically and retain the access door on the cabinet housing in the opened position merely by a worker moving the access door to the desired opened position. Further, the access door is retained in the opened position until it has been released manually by the worker from such position.

Accordingly, the present invention is directed to a door retainer mechanism for retaining an access door on a cabinet in an opened position. The door retainer mechanism comprises: (a) a first link pivotally coupled to a housing of a cabinet pivotally mounting an access door for movement between opened and closed positions; (b) a second link pivotally coupled to the access door and pivotally coupled to the first link such that the first and second links undergo pivotal movement relative to the cabinet housing and access door and relative to each other between retracted and extended, and, more particularly, relatively folded and unfolded, conditions with respect to one another as the access door is moved between the closed and opened positions relative to the cabinet housing; and (c) first and second latching elements defined on the first and second links and being operable automatically to latch the first and second links to one another in the unfolded condition upon the access door reaching the opened position and the first and second links reaching the unfolded condition and thereby to retain the first and second links in the unfolded condition and the access door in the opened position and prevent the first and second links from returning to the folded condition and the access door from returning to the closed position. The first and second latching elements also are operable manually to unlatch the first and second links from one another and thereby release the access door from the opened position such that the first and second latching elements can be returned to the folded condition as the access door is returned to the closed position.

The first and second links in the folded condition are disposed in a substantially side-by-side relationship to one another, whereas in the unfolded condition they are latched in a substantially end-to-end relationship to one another. Also, the first latching element on the first link is positioned in an offset relation above the second latching element on the second link when the links are disposed in the folded condition, whereas the first latching element is positioned within the second latching element when the links are latched in the unfolded condition so as to prevent pivotal movement of the links relative to one another. More specifically, the first and second latching elements have complementary asymmetrical configurations permitting the first latching elements to fit within the second latching element in only one orientation, that being, when the links are latched in the unfolded condition. The door retainer mechanism also includes first and second stop elements mounted to a respective one of the links and engageable with the respective other thereof so as to prevent the links from over-shooting the respective folded and unfolded conditions.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
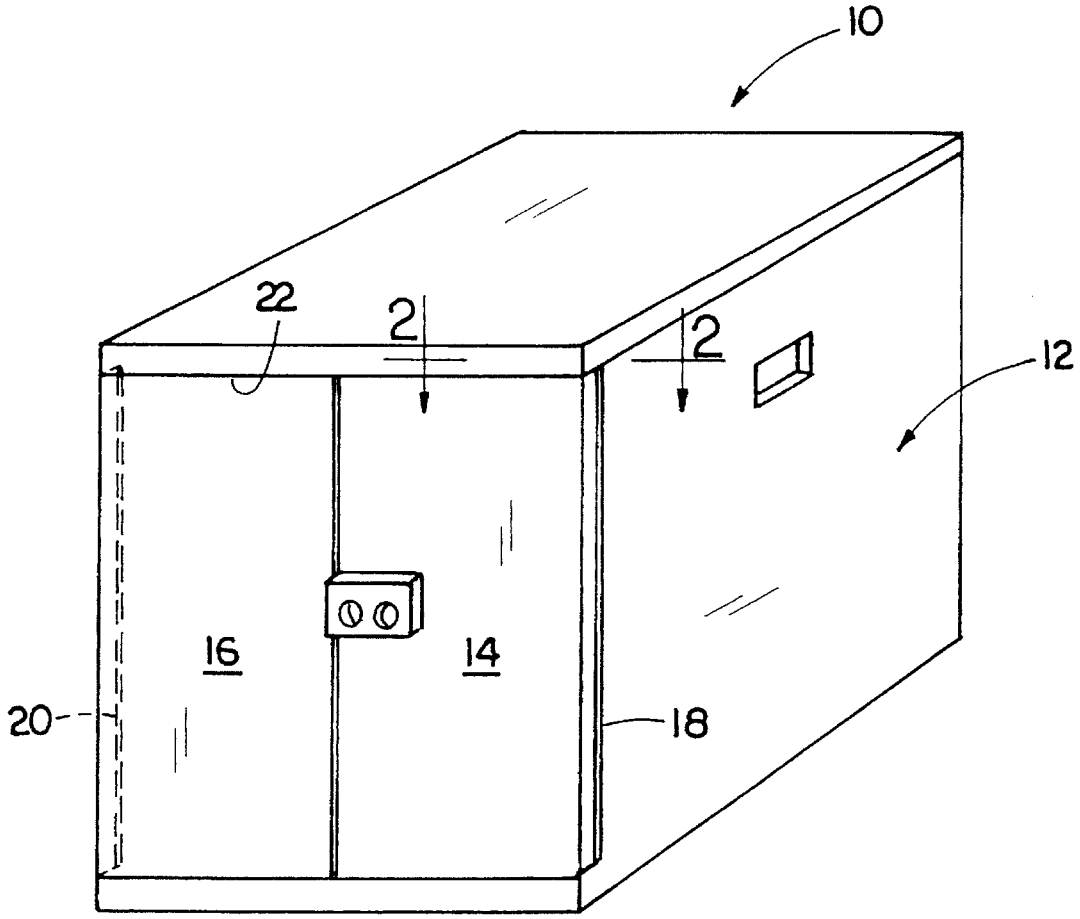
FIG. 1 is a perspective view of a padmounted switchgear cabinet having a pair of front access doors shown in closed positions.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated a padmounted switchgear cabinet 10 which includes an enclosure or housing 12 and a pair of front right and left access doors 14, 16 having hinges 18, 20 at their outer vertical edges pivotally attaching the access doors 14, 16 to the housing 12 for undergoing pivotal movement between closed and opened positions. As shown in FIG. 1, in closed positions the access doors 14, 16 are disposed in a flush relationship with the front of the housing 12, extending across a large access opening 22 defined therein and surrounded by a sill 24 (FIGS. 2 and 6) on the housing 12. In opened positions, the access doors 14, 16 are each disposed in opposite angular relationships with respect to the front of the housing 12, extending away from the housing front and exposing the large access opening 22 thereof.

Figure 2:
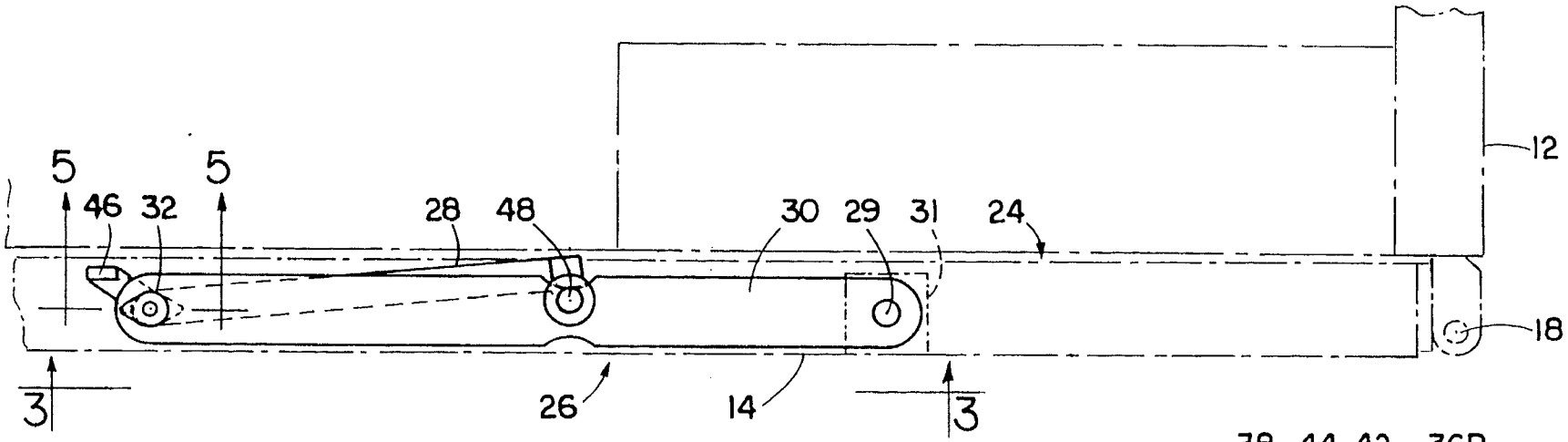
FIG. 2 is an enlarged fragmentary breakaway view of the cabinet taken along line 2—2 of FIG. 1 so as to expose a door retainer mechanism connected to the right one of the access doors of the cabinet, the door retainer mechanism being shown having a pair of first and second links disposed in a relatively folded condition with respect to one another and the access door in the closed position.
Figure 3:
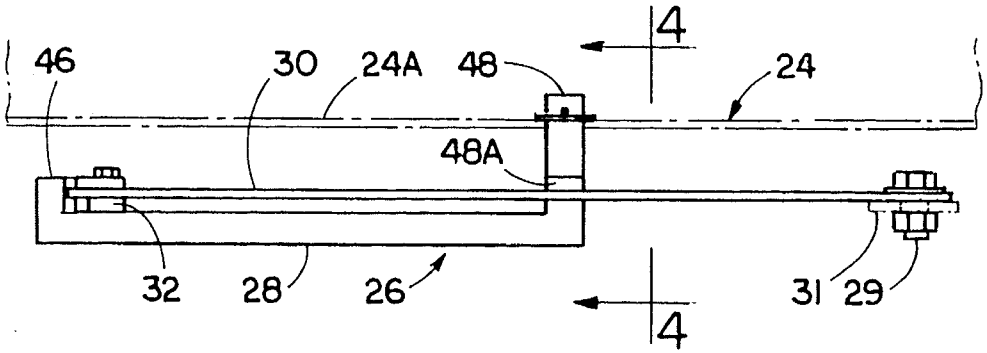
FIG. 3 is a side elevational view of the door retainer mechanism with the first and second links thereof shown in the folded condition with respect to one another and the access door in the closed position.
Figure 6:
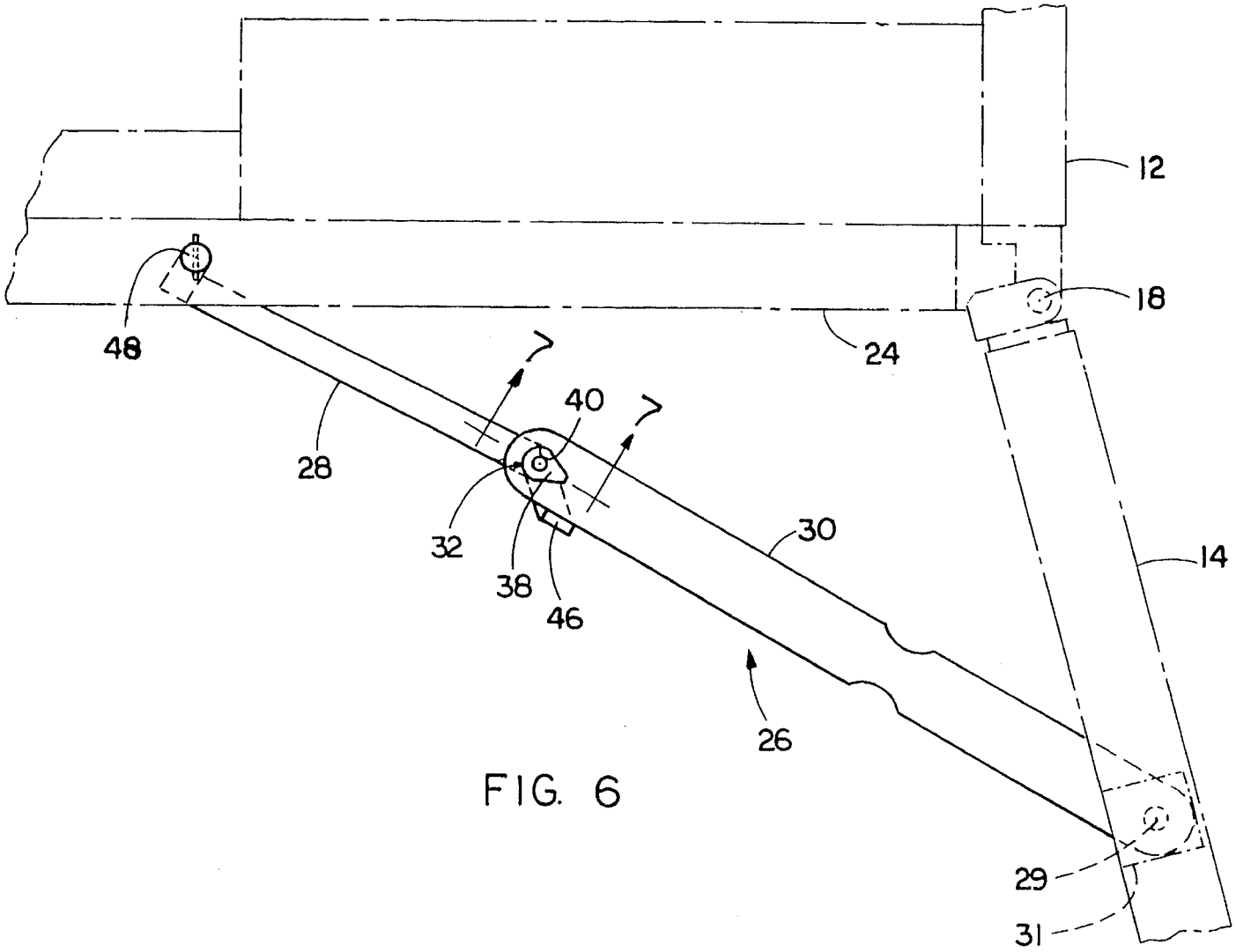
FIG. 6 is a view similar to that of FIG. 2, but with the door retainer mechanism being shown with the first and second links thereof in a relatively unfolded condition with respect to one another and the access door in an opened condition.
Figure 8:
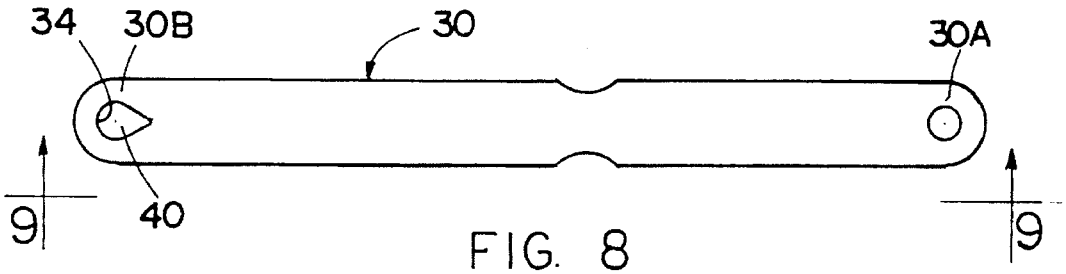
FIG. 8 is a top plan view of the second link of the door retainer mechanism.
Figure 9:
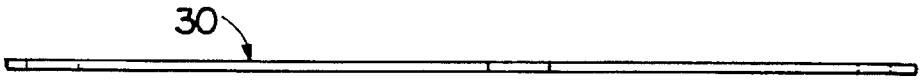
FIG. 9 is a side elevational view of the second link as seen along line 9—9 of FIG. 8.
Figure 11:
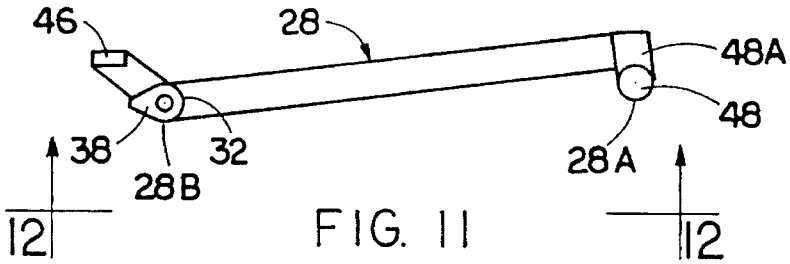
FIG. 11 is a top plan view of the first link of the door retainer mechanism.
Figure 12:
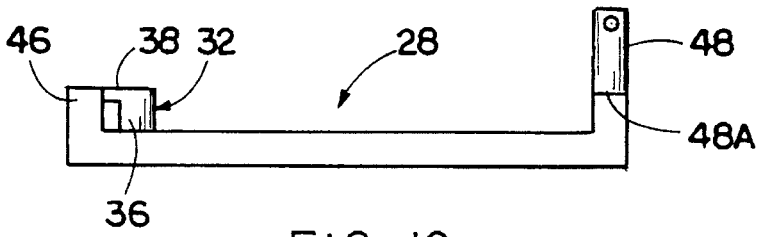
FIG. 12 is a side elevational view of the first link of the door retainer mechanism.
Figure 10:
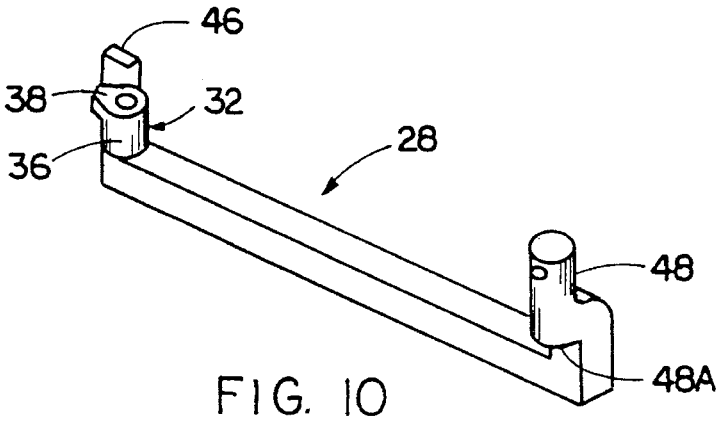
FIG. 10 is a perspective view of the first link of the door retainer mechanism.

Associated with and located inside each of the access doors 14, 16 is a door retainer mechanism of the present invention, being generally designated 26. One door retainer mechanism 26 is associated with each access door 14, 16. Referring to FIGS. 2 and 6, there is illustrated only the door retainer mechanism 26 coupled between the housing 12 of the cabinet 10 and the right access door 14 thereof, as viewed by a worker standing at and facing toward the front of the cabinet 10 where the access doors 14, 16 are located. The other door retainer mechanism (not illustrated) which is connected to the left access door 16 is identical to the one illustrated door retainer mechanism 26 and so the description of the illustrated one will suffice for both. The door retainer mechanism 26 is operable to move from a retracted, or more particularly relatively folded, condition, as shown in FIGS. 2 and 3, to an extended, or more particularly relatively unfolded, condition, as shown in FIG. 6. In the folded condition, the door retainer mechanism 26 is located inside of the cabinet 10, just below an upper portion 24A of the sill 24, and along and within the depth of an upper portion of the respective one access door 14. In the unfolded condition, the door retainer mechanism 26 extends from the cabinet 10 outwardly through the front access opening 22 thereof. The door retainer mechanism 26 is moved between the folded and unfolded conditions in response to movement of the respective access door 14 between the closed and opened positions.

Referring to FIGS. 2 to 12, the door retainer mechanism 26 basically includes a first elongated link 28, a second elongated link 30, and first and second latching elements 32, 34 defined on the first and second links 28, 30. The first link 28 has a pair of opposite first and second ends 28A, 28B and is pivotally coupled at the first end 28A to the sill 24 of the cabinet housing 12. The second link 30 has a pair of opposite first and second ends 30A, 30B and is pivotally coupled at the first end 30A to the access door 14 by a fastener 29 pivotally coupled to a tab 31 on the access door 14. The first and second links 28, 30 are pivotally coupled to each other at their second ends 28B, 30B. Thus, the first and second links 28, 30 are pivotally coupled to undergo pivotal movement relative to the cabinet housing 12 and access door 14 and also relative to each other between the folded condition of FIG. 2 and the unfolded condition of FIG. 6, as the access door 14 is moved between the closed and opened positions relative to the cabinet housing 12. In the folded condition shown in FIG. 2, the first and second links 28, 30 are disposed in a substantially side-by-side relationship to one another, while in the unfolded condition shown in FIG. 6, the first and second links 28, 30 are disposed in a substantially end-to-end relationship to one another.

The first and second latching elements 32, 34 serve dual functions: not only do they provide the function of latching the links 28, 30 to one another and of unlatching the links 28, 30 from each other at their second ends 28B, 30B, they also provide the function of pivotally coupling the links 28, 30 to each other at the second ends 28B, 30B thereof. In the illustrated embodiment of the present invention, the first latching element 32 is in the form of a pivot pin 36 attached at an inner end 36A on and extending transversely outwardly from the second end 28B of the first link 28, and a head 38 attached on an outer end 36B of the pivot pin 36. Also, in the illustrated embodiment of the present invention, the second latching element 34 is a hole 40 defined through the second end 30B of the second link 30. The pivot pin 36 has a cross-sectional size smaller than that of the hole 40 such that the pivot pin 36 freely fits through the hole 40 and is rotatable through 360° relative to it. Further, the first link 28 is disposed below the second link 30 such that the pivot pin 36 on the first link 28 extends upwardly through the hole 40 defined in the second link 30. The pivot pin 36 and hole 40 thus together provide the function of pivotal coupling the second ends 28B, 30B of the first and second links 28, 30 to one another so that they can undergo pivotal movement relative to one another as the pivot pin 36 extending through the hole 40 is rotatable relative thereto.

The head 38 formed on the outer end 36B of the pivot pin 36 of the first link 28 along with the respective configurations of the head 38 and hole 40 provide the function of latching and unlatching the links 28, 30 to and from one another. The head 38 and hole 40 have respective matching asymmetrical configurations. In the illustrated embodiment, these asymmetrical configurations are matching teardrop shapes. The asymmetrical characteristic of the configurations means that the head 38 will only register or fit within the hole 40 in one orientation. Thus, the links 28, 30 can only become latched to one another in one orientation, that being, when they are in the unfolded condition with respect to each other. It is not then possible for the links 28, 30 to be assembled incorrectly such that they can become latched in the folded condition when the access door 14 is in the closed position.

Figure 5:
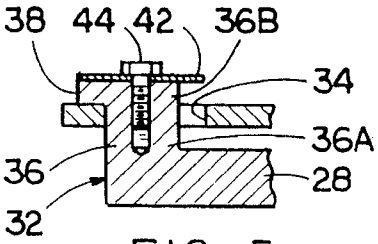
FIG. 5 is an enlarged sectional view taken along line 5—5 of FIG. 2 showing a first latching element on the first link positioned above a second latching element on the second link such that the links are unlatched from one another and thus can be pivoted relative to one another so that the access door can be moved between its opened and closed positions.
Figure 7:
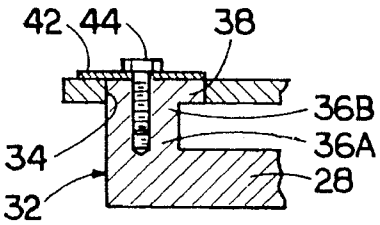
FIG. 7 is an enlarged sectional view taken along line 7—7 of FIG. 6, being a view similar to that of FIG. 6, but with the first latching element on the first link positioned within the second latching element on the second link such that the links are latched with one another and thus cannot be pivoted relative to one another so that the access door cannot be moved away from its opened position.

In the folded condition of the links 28, 30 as seen in FIGS. 2, 3 and 5, in which they are unlatched from one another and thus free to rotate or pivot relative to one another, the head 38 on the first link 28 is disposed in offset relation above the hole 40 through the second link 30. On the other hand, in the unfolded condition of the links 28, 30 as seen in FIGS. 6 and 7, in which they are latched with one another and thus prevented from rotating or pivoting relative to one another, the head 38 is disposed within the hole 40. With the head 38 being smaller in size than the hole 40, the first link 28 will drop automatically relative to the second link 30 under the influence of gravitation force and the head 38 thereon will become fitted within the hole 40 when the asymmetrical configuration of the head 38 becomes aligned with the matching asymmetrical configuration of the hole 40. Such alignment and interfitted relationship of the head 38 in the hole 40 will prevent pivotal movement of the first and second links 28, 30 relative to one another. As shown in FIGS. 5 and 7, the presence of a washer 42 mounted by a fastener 44 to overlie the head 38 and the extension of the periphery of the washer 42 beyond the perimeter of the head 38 limits the downward travel of the first latching element, 32 and the first link 28 to where the head 38 is seated within the hole 40. In other embodiments of the invention (not shown), bias means such as a compression spring may be utilized to further assure the latching.

Thus, given the constructions described above, it can readily be understood that the first and second latching elements 32, 34 are operable automatically to latch the first and second links 28, 30 to one another in the unfolded condition upon the access door 14 reaching the opened position and the first and second links 28, 30 reaching the unfolded condition. Such automatic latching retains the first and second links 28, 30 in the unfolded condition and the access door 14 in the opened position without requiring any action by a worker in addition to opening the access door 14 to the desired opened position. Such automatic latching prevents the first and second links 28, 30 from returning to the folded condition and the access door 14 from returning to the closed position in an unexpected manner.

When it is desired to close the access door 14, the first and second latching elements 32, 34 are then operable manually to unlatch the first and second links 28, 30 from one another simply by a worker lifting up on the first link 28 and thereby release the access door 14 from the opened position such that the first and second links 28, 30 can be returned to the folded condition as the access door 14 is returned to the closed position.

The door retainer mechanism 26 also includes first and second stop elements 46, 48 defined on the first link 28 and being engageable with portions of the second link 30. The first stop element 46 is provided to prevent overtravel of the links 28, 30 past their unfolded condition, whereas the second stop element 48 is provided to prevent overtravel of the links 28, 30 past their folded condition. The first and second stop elements 46, 48 together ensure that the links 28, 30 fold up and unfold in only one direction and that the links do not extend into the interior of the cabinet housing 12 in their folded condition.

Figure 4:
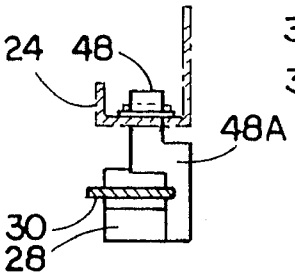
FIG. 4 is an enlarged end elevational view of the housing link of the door retainer mechanism, as seen along line 4—4 of FIG. 3.

The first stop element 46 is in the form of a projection 46 attached on and extending upwardly from the second end 28B of the first link 28. The second stop element 48 is in the form of a shaft 48 attached on and extending upwardly from the first end 28A of the first link 28. The shaft 48 also is employed to pivotally mount the first link 28 to the cabinet sill 24, as seen in FIGS. 3 and 4. The shaft 48 has an offset portion 48A which permits the first and second links 28, 30 to be disposed adjacent to one another with the first link 28 below the second link 30 in the folded condition.

The first stop element 46 is displaced from the second link 30, as shown in FIG. 2, when the first and second links 28, 30 are disposed in the folded condition and engages the second link 30, as shown in FIG. 6, when the first and second links 28, 30 are disposed in the unfolded condition. The second stop element 48 is displaced from the second link 30, as seen in FIG. 6, when the first and second links 28, 30 are disposed in their unfolded condition and engages the second link 30, as seen in FIG. 6, when the first and second links 28, 30 are disposed in their folded condition, as seen in FIGS. 2 and 4.

For minimizing costs in fabrication of the mechanism 26 and as one example, the first link 28 which incorporates the pivot pin 36 and head 38 and the first and second stop elements 46, 48 is preferably fabricated as a casted component of relative short length. On the other hand, the second link 30 which merely incorporates holes at the opposite ends thereof is preferably fabricated as a flat stamped component of relative longer length.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A door retainer mechanism for retaining an access door on a cabinet in an opened position, comprising:

(a) a first link pivotally coupled at a first end to a housing of the cabinet pivotally mounting an access door for movement between opened and closed positions;

(b) a second link pivotally coupled at a first end to the access door and pivotally coupled at a second end to a second end of said first link such that said first and second links undergo pivotal movement about said respective first ends relative to the cabinet housing and access door and about said respective second ends relative to each other between retracted and extended conditions with respect to one another as the access door is moved between the closed and opened positions relative to the cabinet housing; and (c) first and second latching elements respectively defined on said second ends of said first and second links and being operable automatically to latch said first and second links to one another in said extended condition upon the access door reaching the opened position and said first and second links reaching said extended condition and thereby to retain the first and second links in said extended condition and the access door in the opened position and prevent said first and second links from pivotal movement relative to one another about said respective second ends and returning to said retracted condition and the access door from returning to the closed position, said first and second latching elements also being operable manually to unlatch said first and second links from one another and thereby release the access door from the opened position such that said first and second latching elements can be pivoted about said respective second ends and returned to said retracted condition as the access door is returned to the closed position, one of said first and second latching elements having a symmetrical configuration and an asymmetrical configuration and the other of said first and second latching elements having a complementary asymmetrical configuration permitting one of said latching elements to fit within the other of said latching elements in only one orientation upon registry of said asymmetrical configurations when said first and second links are latched in said extended condition so as to prevent pivotal movement of said links relative to one another.

2. The mechanism as recited in claim 1, wherein said links when in said retracted condition are disposed in a substantially side-by-side relationship to one another.

3. The mechanism as recited in claim 1, wherein said links when in said extended condition are disposed in a substantially end-to-end relationship to one another.

4. The mechanism as recited in claim 1, wherein said first latching element on said first link is positioned in offset relation from said second latching element on said second link when said links are disposed in said retracted condition.

5. The mechanism as recited in claim 1, wherein said first latching element on said first link is positioned above said second latching element on said second link when said links are disposed in said retracted condition.

6. The mechanism as recited in claim 1, wherein:

said second latching element is a hole defined through said second end of said second link, said hole having said asymmetrical configuration; and said first latching element includes a pivot pin on said second end of said first link having a symmetrical configuration and extending through and being rotatable about and relative to said asymmetrical configured hole defined through said second link to permit pivotal movement of said links relative to one another, said first latching element also including a head formed on an end of said pivot pin having said asymmetrical configuration, said asymmetrical configured head being offset from said hole when said links are disposed in said retracted condition and being disposed within and in registry with said asymmetrical configured hole in only said one orientation when said links are latched in said extended condition to prevent pivotal movement of said links relative to one another.

7. The mechanism as recited in claim 1, further comprising:

a first stop element defined on one of said links and engageable with the other of said links such that said first stop element and said other link are displaced from one another when said links are disposed in said retracted condition and are engaged with one another when said links are disposed in said extended condition.

8. The mechanism as recited in claim 1, further comprising:

a second stop element defined on one of said links and engageable with the other of said links such that said second stop element and said other link are displaced from one another when said links are disposed in said extended condition and are engaged with one another when said links are disposed in said retracted condition.

* * * * *